US006652321B2

(12) United States Patent
Liu

(10) Patent No.: US 6,652,321 B2
(45) Date of Patent: Nov. 25, 2003

(54) WATERPROOF SAFETY PLUG

(76) Inventor: Tzu-Chen Liu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/050,707

(22) Filed: Jan. 18, 2002

(65) Prior Publication Data

US 2003/0139097 A1 Jul. 24, 2003

(51) Int. Cl.[7] ..... H01R 13/68

(52) U.S. Cl. ..... 439/622; 174/65 R; 174/135; 439/695

(58) Field of Search ..... 174/65 G, 135, 174/65 R, 65 SS, 152 G, 153 G, 151; 16/2.1, 2.2; 248/56; 439/695, 622, 621; 337/197, 198, 186, 142

(56) References Cited

U.S. PATENT DOCUMENTS 3,123,662 A * 3/1964 Fink ..... 174/65 G
3,206,539 A * 9/1965 Kelly ..... 174/153 G
5,886,300 A * 3/1999 Strickler ..... 174/65 G
6,150,608 A * 11/2000 Wambeke et al. ..... 174/65 G
6,297,456 B1 * 10/2001 Nakatani ..... 174/65 G

* cited by examiner

*Primary Examiner*—Dhiru R Patel
(74) *Attorney, Agent, or Firm*—Troxell Law Office PLLC

(57) ABSTRACT

A waterproof safety plug includes a shell body, an inserting core, a valve, a fuse, a rectangular concaved body and a conducting tab; the upper and the lower aspects of the receiving chamber of the shell body are disposed with a v-shaped rib and an inverted v-shaped rib; two sides of the said valve form grooves and two sides of a n-shaped door slot at the upper aspect of one lateral side of the receiving chamber form downward flanges to tightly insert the valve into the receiving chamber; furthermore, openings of inserting tab holes of the said inserting core are disposed on different planes; the economic, practical and safe effect can thereby be achieved by strengthened waterproofing and safety through the featuring design of the abovementioned components.

3 Claims, 5 Drawing Sheets

WATERPROOF SAFETY PLUG

BACKGROUND OF THE INVENTION

1) Field of the Invention

The present invention relates to a waterproof safety plug, more especially to a plug capable of facilitating the user to easily replace a fuse and strengthening waterproofing and safety thereof to achieve the economic, practical and safe effect.

2) Description of the Prior Art

Accordingly, in the era of continuous development of techniques, people pays more attention to the necessities for daily life; various household electric products have become necessary equipments; along with it, the electric wire plugs are parts of the indispensable components; therefore, in order to increase the safety and practicality thereof, some industrials researched and developed a waterproof electric wire plug.

The general waterproof electric wire plugs are assembled and mainly comprise a shell body, an inserting core, a valve, a fuse and a conducting tab (not shown); mainly, the conducting tabs of the positive and the negative poles are inserted into the inserting tab holes disposed on the inserting core; then the fuse is connected to the conducting tab, the inserting core is inserted into the shell body and the valve is inserted into the upper aspect of one lateral side of the shell body; finally, the assembly is accomplished by penetrating and fastening a screw through a thread hole at the upper and lower aspects on the surface of the shell body.

However, the general waterproof electric wire plug has the following shortcomings:

1. There are gaps in the assembled fittings of the general waterproof electric wire plug, therefore the waterproof effect obtained after the assembly will be less preferred.
2. Although the rainwater can be drained through a water outlet disposed inside the waterproof electric wire plug, shortage tends to occur inside the plug due to the moist and that might endanger the user's life.
3. In a general waterproof electric wire plug, the openings of the inserting tab of the inserting core are disposed on the same plane to be inserted by the conducting tabs of the positive and the negative poles; since there is no isolating structure between conducting tabs of the positive and the negative poles, shortage tends to occur when the rainwater permeates and that might damage the plug.
4. Two sides of the valve of the general waterproof electric wire plug are designed to extend as flat and smooth planes, as shown in FIG. 1; therefore, when the valve is inserted into the upper aspect of one lateral side of the shell body, there is gap left on the jointed planes to allow the rainwater to permeate.
5. The inserting core of the general waterproof electric wire plug is only disposed with the fuse to be used, but without the spare fuse; therefore, the user has to search for an extra one when the fuse to be used is burned.

SUMMARY OF THE INVENTION

The present invention mainly comprises a shell body, an inserting core, a valve, a fuse, a rectangular concaved body and a conducting tab; mainly, the conducting tabs of the positive and the negative poles are inserted into inserting tab holes with upward and downward openings disposed in the inserting core; two sides of the said inserting tab holes are disposed with insolating piers with gradients for tightening the engagement of the inserting tab hole and the conducting tab; a fuse to be used is connected with a conducting tab and placed into a rectangular concaved body; then a spare fuse is place inside an u-shaped door slot disposed at the lower aspect on one lateral side of a receiving chamber of the shell body; a v-shaped slot and an inverted v-shaped slot disposed at the upper and the lower aspects in the central area of the inserting core are aligned to insert into a v-shaped rib and an inverted v-shaped rib disposed at the upper and the lower aspects in the central area of the receiving chamber; the valve with two sides formed into grooves is then inserted into a n-shaped door slot with two sides formed into downward flanges disposed at the upper aspect on one lateral side of the receiving chamber; finally, the assembled plug is placed in a die set for sealing; after being injected into molds and processed, the plastic material is poured in at the outlet area to tightly joint the electric wire and the plug as well as to close the gap left during the assembly.

The primary objective of the present invention is to design the v-shaped rib and the inverted v-shaped rib disposed at the upper and the lower aspects in the central area of the receiving chamber as well as the v-shaped slot and an inverted v-shaped slot disposed at the upper and the lower aspects in the central area of the inserting core to tightly insert the inserting core into the shell body.

The secondary objective of the present invention is to use the design of the grooves formed by two sides of the valve and the downward flanges formed by two sides of the n-shaped door slot at the upper aspect on one lateral side of the receiving chamber to tightly insert the valve into the upper aspect of one lateral side of the receiving chamber.

Another objective of the present invention is to dispose the openings of the inserting tab holes of the inserting core on different planes to block the permeation of the rainwater so as to eliminate the shortcomings of the general waterproof electric wire plug with the inserting tab holes of the inserting core disposed on the same plane; furthermore, isolating piers with gradients are disposed on two sides of the inserting tab hole to tightly couple the inserting tab hole and the conducting tab.

Yet another objective of the present invention is to provide a spare fuse disposed in a rectangular concave slot at the rear aspect of the inserting tab hole with upward opening of the inserting core for facilitating the user in replacing the fuse when the fuse to be used is burned.

To enable a further understanding of the effect, the structure and the features of the present invention, the brief description of the drawings below is followed by the detailed description of the preferred embodiment.

DETAILED DESCRIPTION OF THE PREFERRED EMBODIMENTS

Figure 1:
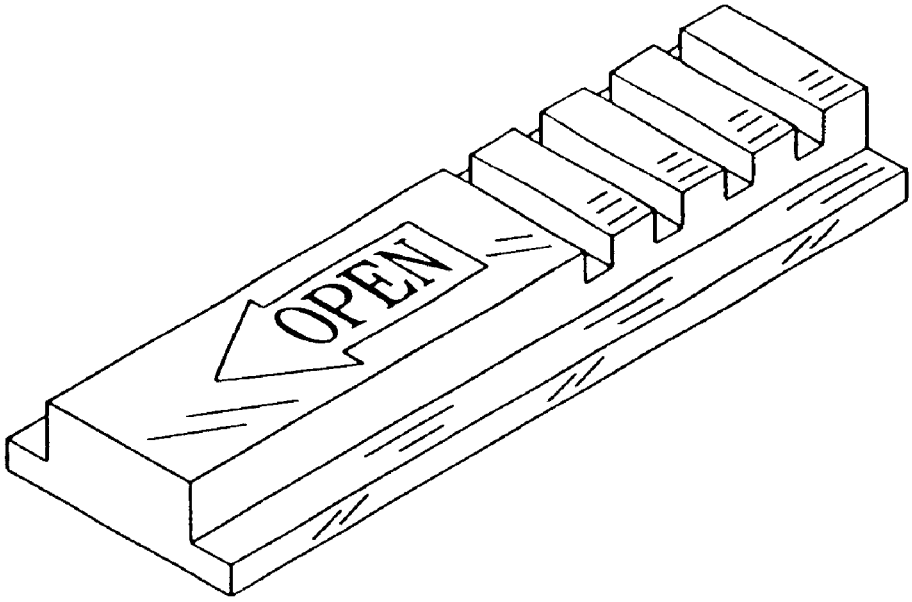
FIG.1 Prior Art
FIG. 1 is a pictorial drawing of a valve of a prior art.
Figure 2:
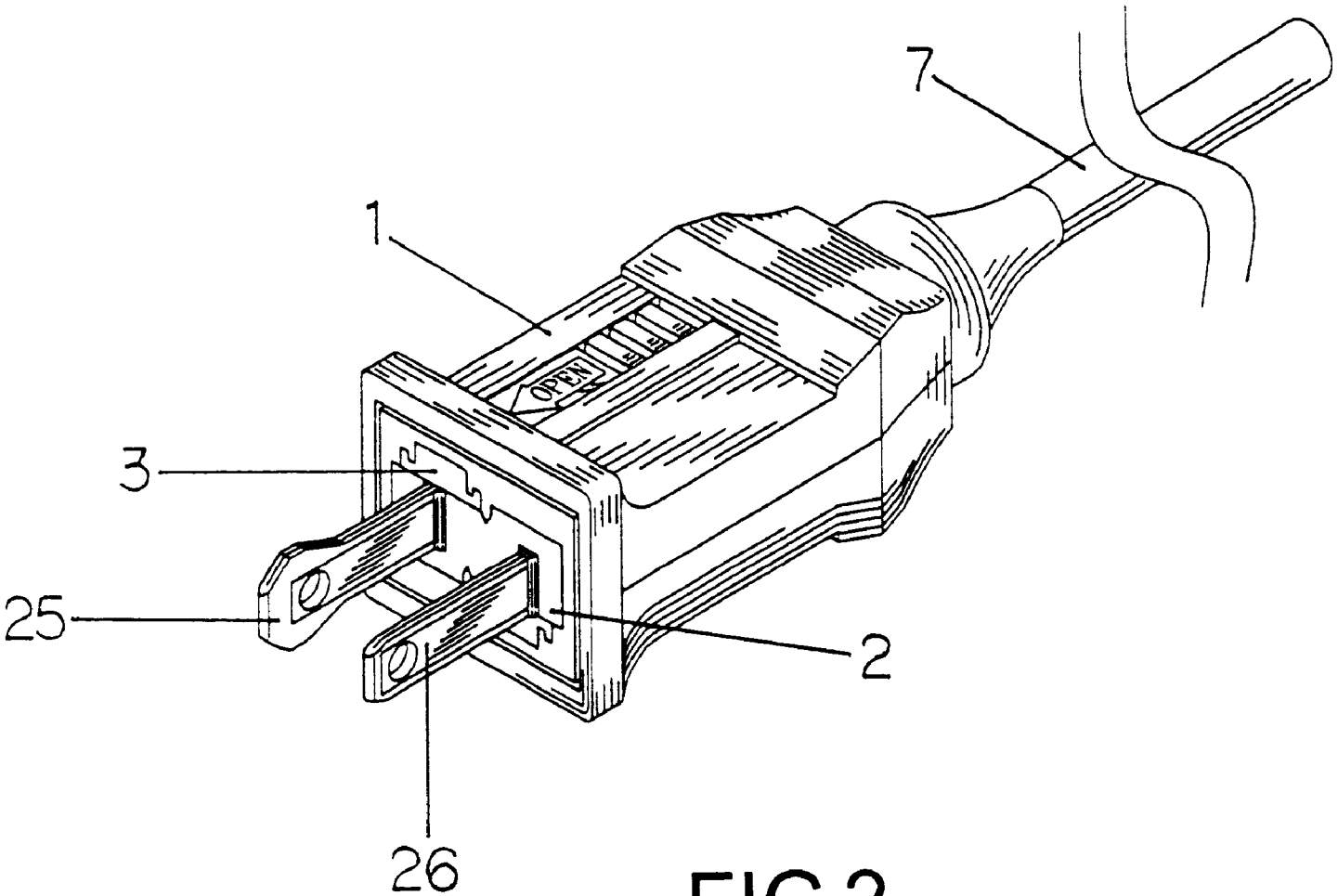
FIG. 2 is a pictorial drawing of the present invention.
Figure 3:
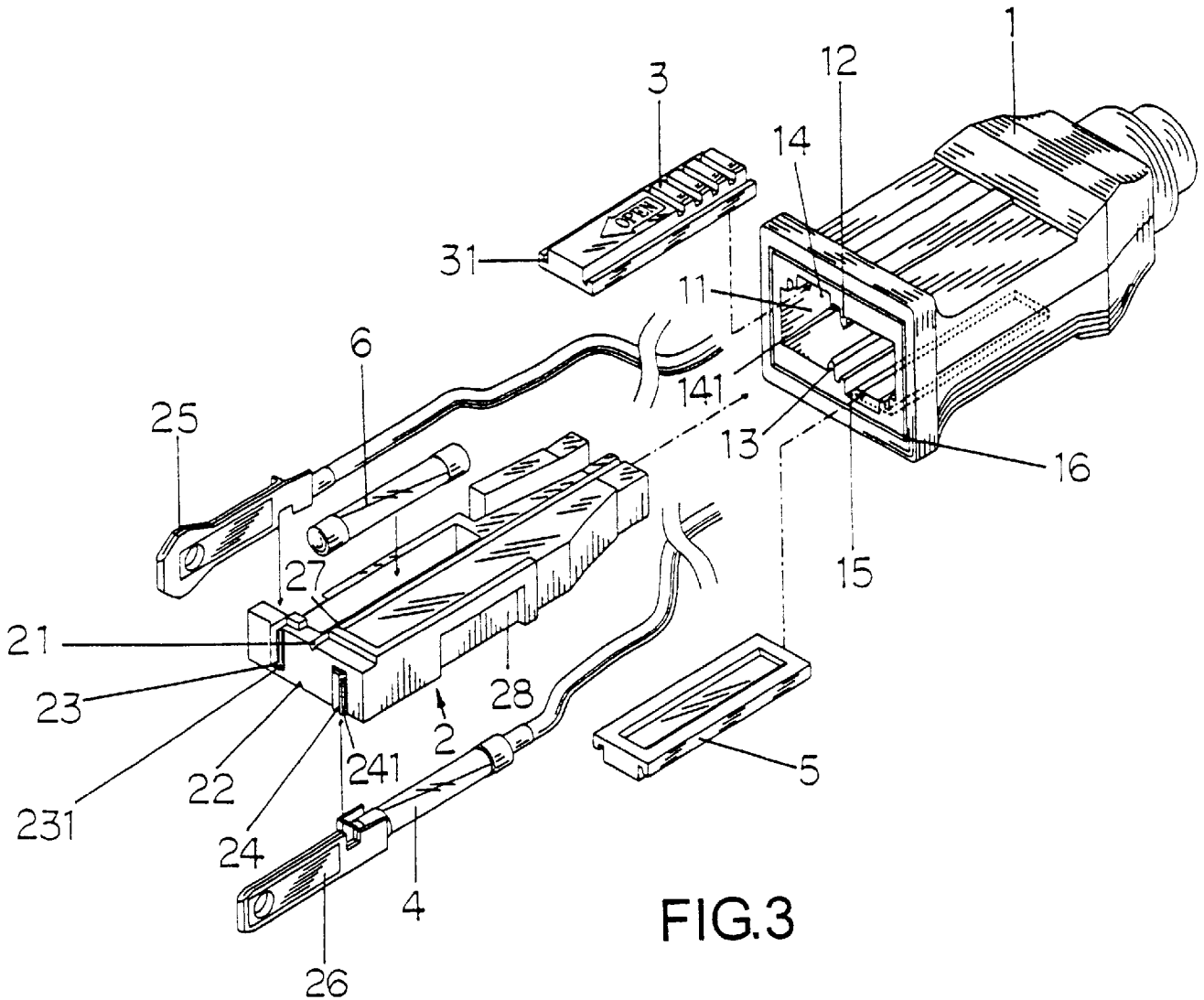
FIG. 3 is an exploded and pictorial drawing of the present invention.

Referring to FIGS. 2 and 3, the present invention comprises a shell body (1) disposed with a receiving chamber (11) therein for inserting in an inserting core (2); a v-shaped rib (12) and an inverted v-shaped rib (13) are respectively disposed at the upper and the lower aspects in the central area inside the said receiving chamber (11) to fitly engage with a v-shaped slot (21) and an inverted v-shaped slot (22) disposed at the upper and the lower aspects in the central area of the inserting core (2); the upper aspect of one lateral side of the said receiving chamber (11) is disposed with a n-shaped door slot (14) with two sides thereof formed into downward flanges (141) for inserting grooves (31) formed by two sides of a valve (3); the lower aspect of the other lateral side is disposed with an u-shaped door slot (15) for inserting a rectangular concave body (5) used for placing a fuse to be used (4); a rectangular groove (16) is disposed on the front peripheral rim of the receiving chamber (11) to prevent the permeation of the rainwater.

An inserting core (2) is inserted into the receiving chamber (11) of the said shell body (1); inserting tab holes (23, 24) with upward and downward openings are disposed on two sides on the front rim to be respectively inserted by conducting tabs (25, 26) of the positive and the negative poles; wherein, the rear aspect of the inserting tab hole (23) with an upward opening is disposed with a rectangular concave slot (27) for inserting the spare fuse (6); the rear aspect of the inserting tab hole (24) with a downward opening forms into a cover slot (28) to fitly cover the rectangular concave slot (5) for placing the fuse to be used (4); isolating piers (231, 241) are disposed along the peripheral rim of the inserting tab holes (23, 24) for strengthening the tight engagement between the inserting tab holes (23, 24) and the conducting tabs (25, 26).

Figures 5, 5A, 5B:
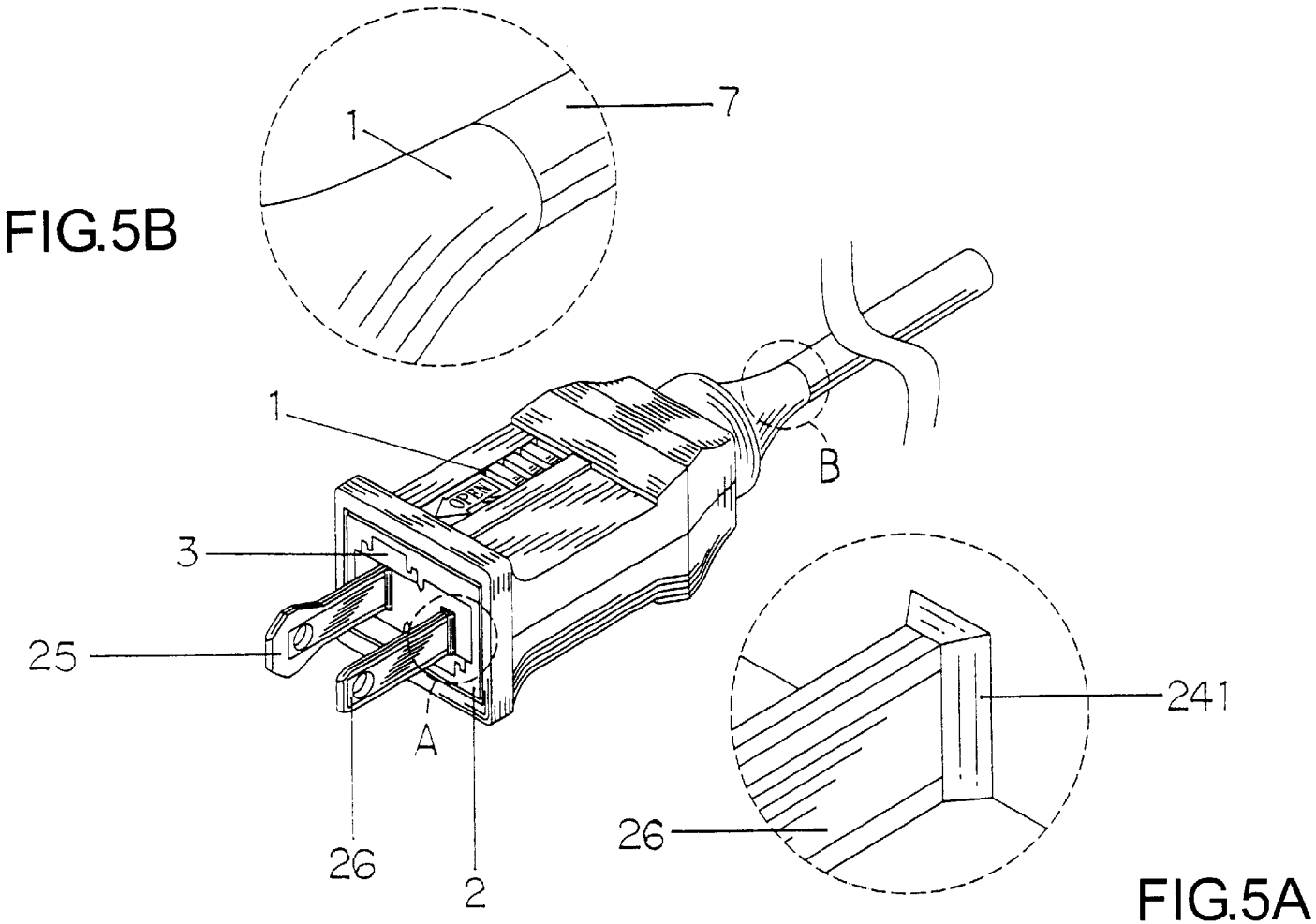
FIG. 5 is a schematic drawing of the present invention.
FIGS. 5A and 5B are partially enlarged views of FIG. 5.

When assembling, first, the conducting tabs (25, 26) of the positive and the negative poles are respectively inserted into the inserting tab hole (23) with an upward opening and the inserting tab hole (24) with a downward opening of the inserting core (2); at the meantime, the isolating piers (231, 241) on the peripheral rim of the inserting tab holes (23, 24) tightly engage with the peripheral rim of two conducting tabs (25, 26); then, a fuse to be used is connected to the rear aspect of the conducting tab (25) of positive pole or the conducting tab (26) of the negative pole as well as placed inside the rectangular concave body (5); a spare fuse (6) is placed in the rectangular concave slot (27) of the inserting core (2); then, the rectangular concave body (5) is inserted into the u-shaped door slot (15) at the lower aspect on one lateral side of the receiving chamber (11); the v-shaped slot (21) and an inverted v-shaped slot (22) disposed at the upper and the lower aspects in the central area of the inserting core (2) are aligned to insert into a v-shaped rib (12) and an inverted v-shaped rib (13) disposed at the upper and the lower aspects in the central area of the receiving chamber (11); at this time, the cover slot (28) of the inserting core (2) fitly covers on the rectangular concave body (5); then the grooves (31) formed by two sides of the valve (3) slide in along downward flanges (141) formed by two sides of the n-shaped door slot (14) at the upper aspect of one side of the receiving chamber (11); finally, the assembled plug is placed inside a die set for sealing; after being injected into molds and processed, plastic material is poured in the outlet area of the electric wire (7) to tightly connect with the plug and close the gap of the electric wire (7) left during assembly; therefore, it not only prevents the rainwater permeation and enhances the isolation of the present invention, but also increases the tensile strength and relatively enhances the waterproofing and safety of the plug, as shown in FIG. 5, FIGS. 5A and 5B.

Figure 4:
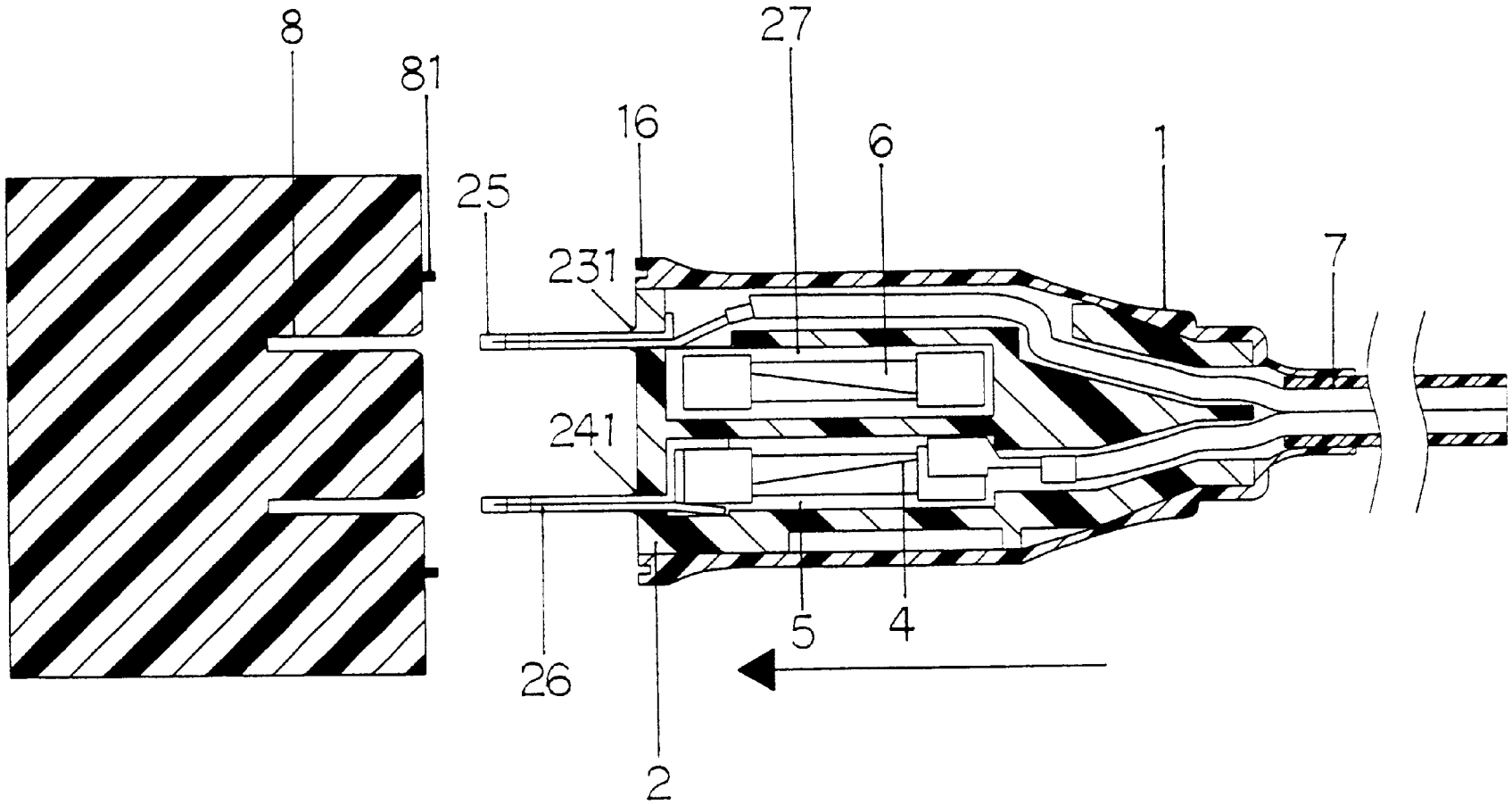
FIG. 4 is a bird's-eye view, cross-sectional and schematic drawing of the present invention.

As indicated in FIG. 4, wherein the rectangular groove (16) is disposed on the peripheral rim on the shell body (1); the peripheral rim of the receptacle holes (8) opposite thereto is correspondingly disposed with a rectangular convex block (81); the sizes of the isolating piers (231, 241) with gradients disposed on the peripheral rim of the said inserting tab holes (23, 24) are the same as that of the gap between the receptacle holes (8); when in use, the plug is inserted into the receptacle holes (8) to fitly insert the said isolating piers (231, 241) into the gap between the receptacle holes (8); the said rectangular groove (16) is fitly inserted into the rectangular convex block (81) to thereby prevent the rainwater permeation and achieve 100% waterproof effect.

When the fuse to be used is burned, the user only has to wrench the valve (3) open to access to the spare fuse (6) in the rectangular concave slot (27) of the inserting core (2) for replacement without troubling in searching for another fuse.

The valve (3) of the present invention is made of stiff and waterproof plastic material to cooperate with the said shell body (1) made of soft and waterproof plastic material with high flexibility for tighter engagement to prevent the permeation of the rainwater.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A waterproof safety plug comprises:

a shell body disposed with a receiving chamber therein for inserting in an inserting core; said shell body has a v-shaped rib and an inverted v-shaped rib are respectively disposed at a first upper surface and a first lower surface in a central area inside said receiving chamber, and said inserting core has a v-shaped slot and an inverted v-shaped slot are respectively disposed at a second upper surface and a second lower surface in a central area of said inserting core to fitly engage with said v-shaped rib and said inverted v-shaped rib of said shell body; said receiving chamber further incudes an n-shaped door slot with two sides thereof formed into downward flanges for inserting grooves formed by two sides of a valve and an u-shaped door slot for inserting a rectangular concave body used for placing a spare fuse to be used; a rectangular groove is disposed on a front peripheral rim of said receiving chamber to prevent the permeation of the rainwater; said inserting core is inserted into the receiving chamber of said shell body; said inserting core further includes inserting tab holes, a rectangular concave slot and a cover slot, said tab holes having upward and downward openings for receiving conducting tabs of the positive and negative poles, and said rectangular concave slot and said cover slot being used for inserting the spare fuse; isolating piers are disposed along a peripheral rim of the inserting tab holes for strengthening tight engagement between the inserting tab holes and the conducting tabs; after the inserting core is inserted into the shell body, the plug is placed in a die set for sealing; after being injected into molds and processed, plastic material is poured in the outlet area of an electric wire to tightly connect the electric wire with the plug as well as to close a gap of the electric wire left during assembly to strengthen the waterproofing and safety of the plug.

2. The waterproof safety plug according to claim 1, wherein the valve is made of stiff and waterproof plastic material cooperating with said shell body made of soft and waterproof plastic material with high flexibility for tighter engagement.

3. The waterproof safety plug according to claim 1, wherein the rectangular groove disposed on the peripheral rim on the shell body being used to insert rectangular convex blocks disposed on a peripheral rim of the opposite receptacle holes; sizes of the isolating piers with gradients disposed on the peripheral rim of said inserting tab holes are the same as that of a gap between the receptacle holes to allow the plug to prevent the permeation of the rainwater thereby to increase the waterproofing and safety of the plug.

* * * * *